US007351307B2

(12) United States Patent
Scherb et al.

(10) Patent No.: US 7,351,307 B2
(45) **Date of Patent: *Apr. 1, 2008**

(54) METHOD OF DEWATERING A FIBROUS WEB WITH A PRESS BELT

(75) Inventors: Thomas Thoröe Scherb, Sao Paulo (BR); Jeffrey Herman, Bala Cynwyld, PA (US); Luiz Carlos Silva, Campo Limpo (BR)

(73) Assignee: Voith Paper Patent GmbH, Heidenheim (DE)

( * ) Notice: Subject to any disclaimer, the term of this patent is extended or adjusted under 35 U.S.C. 154(b) by 581 days.

This patent is subject to a terminal disclaimer.

(21) Appl. No.: 10/768,423

(22) Filed: Jan. 30, 2004

(65) Prior Publication Data

US 2005/0167061 A1 Aug. 4, 2005

(51) Int. Cl.
*D21F 11/00* (2006.01)
*D21F 3/00* (2006.01)

(52) U.S. Cl. ..... 162/115; 162/205; 162/217; 162/117; 34/400; 34/406; 34/444

(58) Field of Classification Search ..... 162/109, 162/115–117, 204–207, 217, 901–904, 358.1, 162/348, 358.3; 139/383 B, 383 R; 34/400, 34/406, 419, 444
See application file for complete search history.

(56) References Cited

U.S. PATENT DOCUMENTS

| | | | | |
|---|---|---|---|---|
| 3,301,746 | A * | 1/1967 | Sisson et al. | 162/113 |
| 3,994,771 | A * | 11/1976 | Morgan et al. | 162/113 |
| 4,102,737 | A * | 7/1978 | Morton | 162/113 |
| 4,162,190 | A | 7/1979 | Ashworth | 162/359 |
| 4,191,609 | A | 3/1980 | Trokhan | |
| 4,948,467 | A * | 8/1990 | Creagan | 162/358.3 |
| 5,510,001 | A * | 4/1996 | Hermans et al. | 162/113 |
| 5,510,002 | A * | 4/1996 | Hermans et al. | 162/113 |
| 5,701,682 | A | 12/1997 | Chuang et al. | 34/115 |
| 5,865,955 | A * | 2/1999 | Ilvespaa et al. | 162/207 |
| 6,051,105 | A | 4/2000 | Ampulski | 162/117 |
| 6,140,260 | A | 10/2000 | Johnson et al. | 442/270 |
| 6,149,767 | A | 11/2000 | Hermans et al. | 162/109 |
| 6,187,137 | B1 * | 2/2001 | Druecke et al. | 162/109 |
| 6,228,220 | B1 * | 5/2001 | Hada et al. | 162/203 |
| 6,436,240 | B1 | 8/2002 | Jeffrey | 162/358.2 |
| 6,454,904 | B1 * | 9/2002 | Hermans et al. | 162/205 |
| 6,497,789 | B1 * | 12/2002 | Hermans et al. | 162/205 |
| 6,780,282 | B2 * | 8/2004 | Scherb et al. | 162/111 |
| 6,855,229 | B2 * | 2/2005 | McKay et al. | 162/179 |
| 2003/0033727 | A1 | 2/2003 | Stelljes, Jr. et al. | 34/361 |
| 2003/0051848 | A1 | 3/2003 | Watanabe | |

(Continued)

FOREIGN PATENT DOCUMENTS

| | | |
|---|---|---|
| DE | 19627891 | 1/1998 |

(Continued)

*Primary Examiner*—José A. Fortuna
(74) *Attorney, Agent, or Firm*—Taylor & Aust, P.C.

(57) ABSTRACT

A method of dewatering a fibrous web in a paper machine including the steps of carrying the fibrous web on a side of a first fabric; contacting the fibrous web with a side of a second fabric, the fibrous web being between the first fabric and the second fabric; and passing air successively through the first fabric, the fibrous web and the second fabric.

34 Claims, 14 Drawing Sheets

U.S. PATENT DOCUMENTS

2003/0056911 A1* 3/2003 Hermans et al. ..... 162/101
2003/0056925 A1* 3/2003 Beck ..... 162/358.1
2003/0070781 A1* 4/2003 Hermans et al. ..... 162/115
2003/0136018 A1 7/2003 Herman et al.
2004/0152574 A1* 8/2004 Beck et al. ..... 492/53
2004/0173333 A1* 9/2004 Hermans et al. ..... 162/358.1
2004/0180596 A1* 9/2004 Beck ..... 442/326
2004/0237210 A1* 12/2004 Thoroe-Scherb et al. .. 8/115.51
2005/0126031 A1* 6/2005 Herman et al. ..... 34/114
2005/0167061 A1* 8/2005 Scherb et al. ..... 162/115
2005/0167062 A1* 8/2005 Herman et al. ..... 162/115
2005/0167066 A1* 8/2005 Herman et al. ..... 162/203
2005/0167068 A1* 8/2005 Herman et al. ..... 162/358.1
2006/0085998 A1* 4/2006 Herman et al. ..... 34/453
2006/0085999 A1* 4/2006 Scherb et al. ..... 34/453
2006/0086473 A1* 4/2006 Herman et al. ..... 162/358.2
2007/0068645 A1* 3/2007 Silva ..... 162/289

FOREIGN PATENT DOCUMENTS

DE 10129613 A1 * 1/2003
EP 0658649 2/1994
EP 1518960 A1 * 3/2005
WO WO/03/062528 7/2003

* cited by examiner

METHOD OF DEWATERING A FIBROUS WEB WITH A PRESS BELT

BACKGROUND OF THE INVENTION

1. Field of the Invention

The present invention relates to a paper machine, and, more particularly, to a method and apparatus of drying a structured fiber web on a structured fabric in a paper machine.

2. Description of the Related Art

In a wet molding process, a structured fabric in the standard Crescent Former press fabric position impresses a three dimensional surface on a web while the fibrous web is still wet. Such an invention is disclosed in International Publication No. WO 03/062528 A1. A suction box is disclosed for the purpose of shaping the fibrous web while wet to generate the three dimensional structure by removing air through the structural fabric. It is a physical displacement of portions of the fibrous web that leads to the three dimensional surface. Similar to the aforementioned method, a through air drying (TAD) technique is disclosed in U.S. Pat. No. 4,191,609. The TAD technique discloses how an already formed web is transferred and molded into an impression fabric. The transformation takes place on a web having a sheet solids level greater that 15%. This results in a low density pillow area in the fibrous web. These pillow areas are of a low basis weight since the already formed web is expanded to fill the valleys thereof. The impression of the fibrous web into a pattern, on an impression fabric, is carried out by passing a vacuum through the impression fabric to mold the fibrous web.

In a wet pressing operation a fibrous web sheet is compressed at a press nip to the point where hydraulic pressure drives water out of the fibrous web. It has been recognized that conventional wet pressing methods are inefficient in that only a small portion of a rollers circumference is used to process the paper web. To overcome this limitation, some attempts have been made to adapt a solid impermeable belt to form an extended nip for pressing the paper web to dewater the paper web. A problem with such an approach is that the impermeable belt prevents the flow of a drying fluid, such as air through the paper web. Extended nip press (ENP) belts are used throughout the paper industry as a way of increasing the actual pressing dwell time in a press nip. A shoe press is the apparatus that provides the ability of the ENP belt to have pressure applied therethrough, by having a stationary shoe that is configured to the curvature of the hard surface being pressed, for example, a solid press roll. In this way the nip can be extended well beyond the limit of the contact between the press rolls themselves. An ENP belt serves as a roll cover on the shoe press. This flexible belt is lubricated on the inside to prevent frictional damage. The belt and shoe press are non-permeable members and dewatering of the fibrous web is accomplished by the mechanical pressing thereof.

A fabric is utilized to carry the fiber web during the formation of the web. After the web takes form it is usually subjected to a drying process. The same fabric used during formation of the web or another fabric may come in contact with the web, to move the web across a vacuum section for the remove of moisture from the web. Additionally the web is sent, with a press fabric, through a press section. The problem is that if a structured fabric is sent to the press section no gain in dryness is achieved without using an expensive TAD method.

What is needed in the art is a method to effectively dewater a structured fibrous web.

SUMMARY OF THE INVENTION

The present invention provides a method and apparatus for dewatering a fibrous web in a paper machine.

The invention comprises, in one form thereof, a method of dewatering a fibrous web in a paper machine including the steps of carrying the fibrous web on a side of a first fabric; contacting the fibrous web with a side of a second fabric, the fibrous web being between the first fabric and the second fabric; and passing air successively through the first fabric, the fibrous web and the second fabric.

An advantage of the present invention is that water is removed from the fibrous web in an efficient manner by the present method.

Another advantage of the present invention is that a thin dewatering fabric with a low retention characteristic removes water from the web.

Still yet another advantage of the present invention is that the dewatering system combines the advantages of a permeable press belt, a dewatering fiber and subsequent drying sections to remove moisture from a fibrous web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
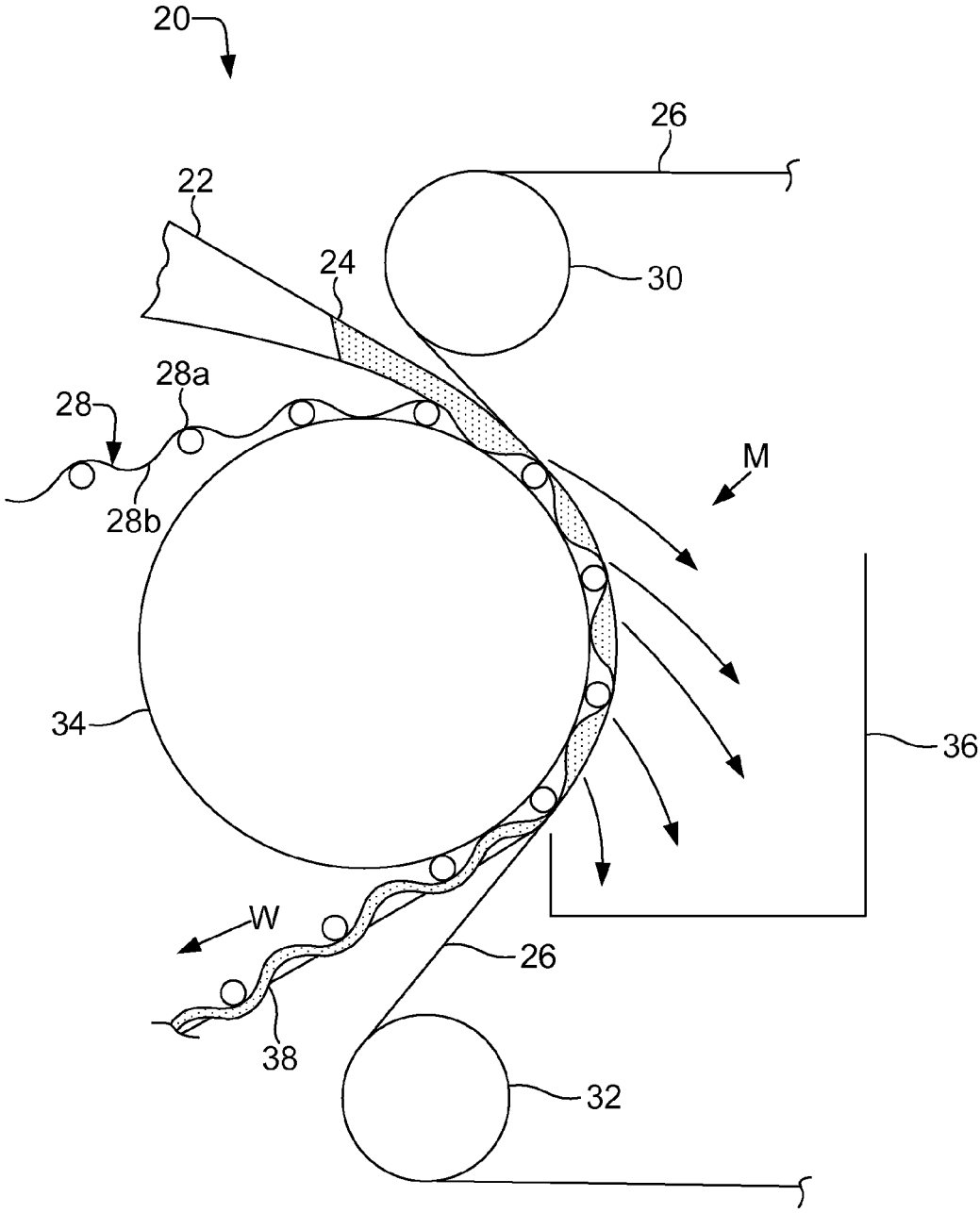
FIG. 1 is a cross-sectional schematical diagram illustrating the formation of a structured web using a method of the present invention.

Referring now to the drawings, and more particularly to FIG. 1, there is a fibrous web machine 20 including a headbox 22 that discharges a fibrous slurry 24 between a forming fabric 26 and a structured fabric 28. Rolls 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks 28*a* and valleys 28*b*, which give a corresponding structure to web 38 formed thereon. Structured fabric 28 travels in direction W, and as moisture M is driven from fibrous slurry 24, structured fibrous web 38 takes form. Moisture M that leaves slurry 24 travels through forming fabric 26 and is collected in save-all 36.

Forming roll 34 may be solid or permeable. Moisture travels through forming fabric 26 but not through structured fabric 28. This advantageously shapes structured fibrous web 38 into a more absorbent web than the prior art.

Figure 2:
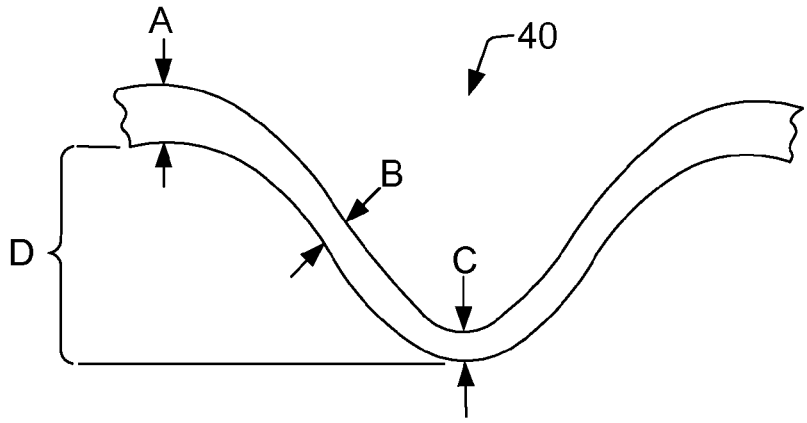
PRIOR ART FIG. 2
FIG. 2 is a cross-sectional view of a portion of a structured web of a prior art method.
Figure 4:
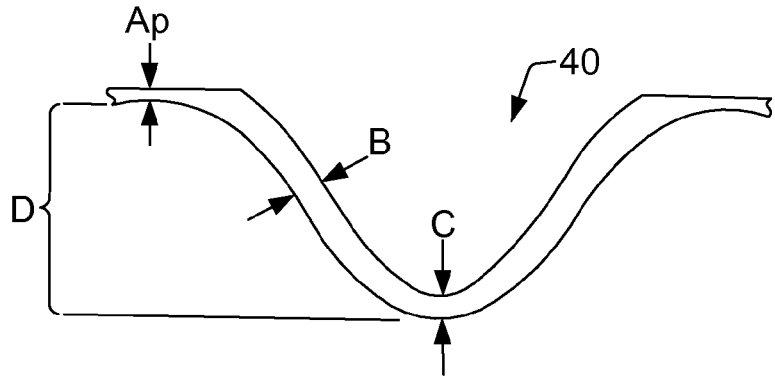
PRIOR ART FIG. 4
FIG. 4 illustrates the web portion of FIG. 2 having subsequently gone through a press drying operation.

Prior art methods of moisture removal, remove moisture through a structured fabric by way of negative pressure. It results in a cross-sectional view as seen in FIG. 2. Prior art structured web 40 has a pocket depth D which corresponds to the dimensional difference between a valley and a peak. The valley occurring at the point where measurement C occurs and the peak occurring at the point where measurement A is taken. A top surface thickness A is formed in the prior art method. Sidewall dimension B and pillow thickness C of the prior art result from moisture drawn through a structured fabric. Dimension C is less than dimension B and dimension B is less than dimension A in the prior art structure. Once fiber web 40 is formed, it is run through a drying operation that includes the use of a press apparatus that reduces dimension A, in particular, to $A_p$ as shown in FIG. 4.

Figure 3:
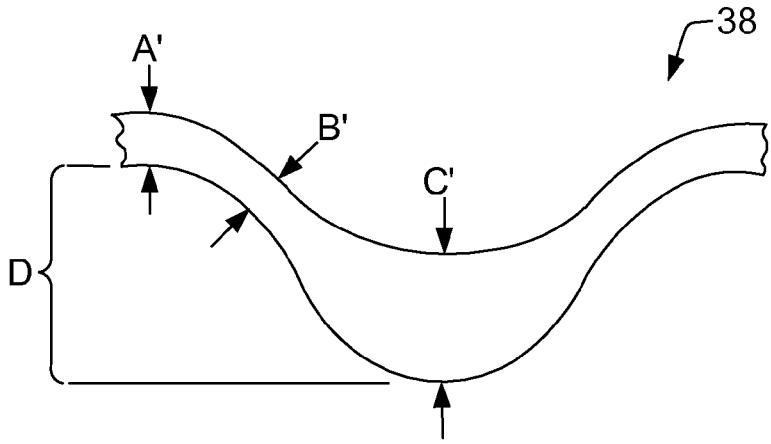
FIG. 3 is a cross-sectional view of a portion of the structured web of the present embodiment as made on the machine of FIG. 1.
Figure 5:
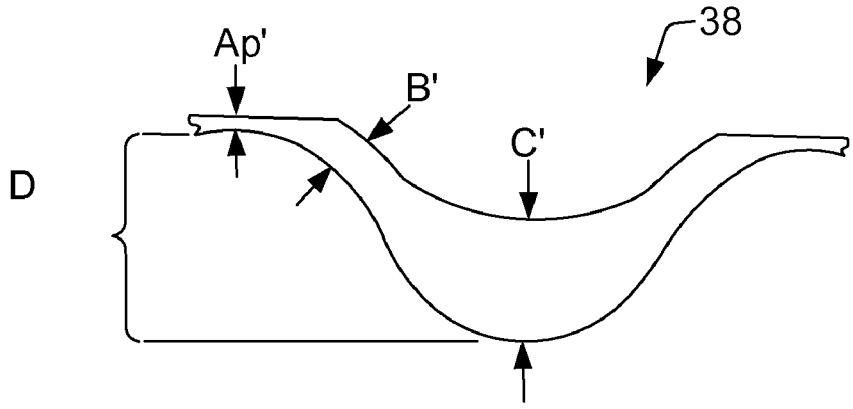
FIG. 5 illustrates a portion of the fiber web of the present invention of FIG. 3 having subsequently gone through a press drying operation.

In contrast, structured web 38, as illustrated in FIGS. 3 and 5, have for discussion purposes, a pocket depth D that is similar to the prior art. However, sidewall thickness B' and pillow thickness C' exceed the comparable dimensions of web 40. This advantageously results from the forming of structural web 38 on structured fabric 28 and the removal of moisture is an opposite direction from the prior art. This results in a thicker pillow dimension C'. Even after fiber web 38 goes through a drying press operation, as illustrated in FIG. 5, dimension C' is substantially greater than $A_p'$. Advantageously, the fiber web resulting from the present invention has a higher fiber density in the pillow areas as compared to prior art. Also, the fiber to fiber bonds are not broken as they can be in prior art impression operations.

Figure 6:
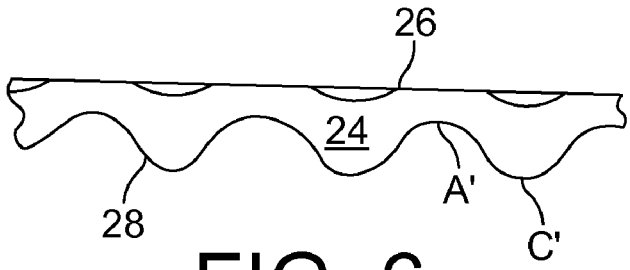
FIG. 6 illustrates a resulting fiber web of the forming section of the present invention.
Figure 8:
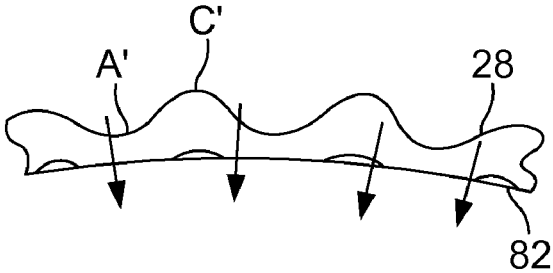
FIG. 8 illustrates the moisture removal of the fiber web of the present invention.

As shown in FIG. 6, fibrous slurry 24 is formed into a web 38 with a structure inherent in the shape of structured fabric 28. Forming fabric 26 is porous and allows moisture to escape during forming. Further, water is removed as shown in FIG. 8, through dewatering fabric 82. The removal of moisture through fabric 82 does not cause a compression of pillow areas C' in the forming web, since pillow areas C' reside in the structure of structured fabric 28.

Figure 7:
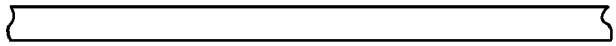
PRIOR ART FIG. 7
FIG. 7 illustrates the fiber web of the forming section of a prior art method.

The prior art web shown in FIG. 7, is formed with a conventional forming fabric as between two conventional forming fabrics in a twin wire former and is characterized by a flat uniform surface. It is this fiber web that is given a three-dimensional structure by a wet shaping stage, which results in the fiber web that is shown in FIG. 2. A conventional tissue machine that employs a conventional press fabric will have a contact area approaching 100%. Normal contact area of the structured fiber, as in this present invention, or as on a TAD machine, is typically much lower than that of a conventional machine, it is in the range of 15 to 35% depending on the particular pattern of the product being made.

Figure 9:
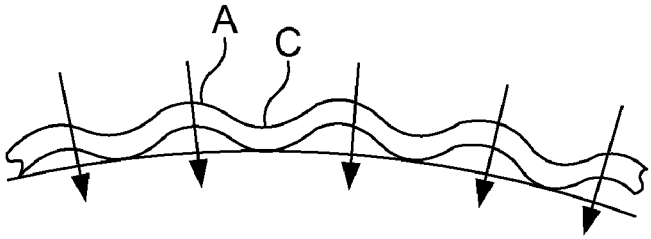
PRIOR ART FIG. 9
FIG. 9 illustrates the moisture removal of the fiber web of a prior art structured web.
Figure 10:
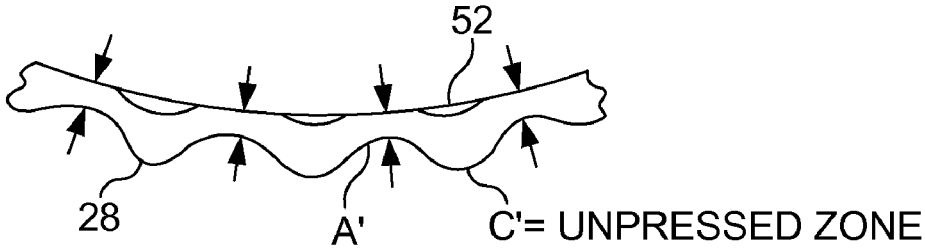
FIG. 10 illustrates the pressing points on a fiber web of the present invention.
Figure 11:
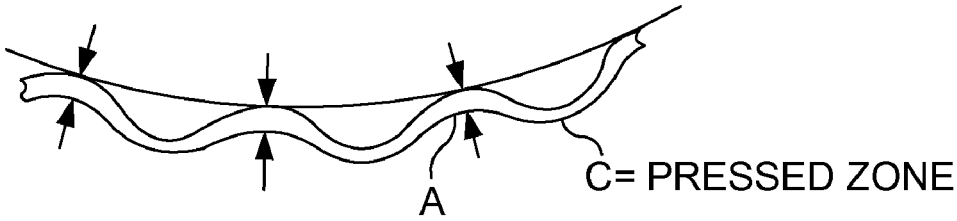
PRIOR ART FIG. 11
FIG. 11 illustrates pressing points of prior art structured web.

In FIGS. 9 and 11 a prior art web structure is shown where moisture is drawn through a structured fabric 33 causing the web, as shown in FIG. 7, to be shaped and causing pillow area C to have a low basis weight as the fibers in the web are drawn into the structure. This additionally causes fiber tearing as they are moved into pillow area C. Subsequent pressing at the Yankee dryer, as shown in FIG. 11, further reduces the basis weight in area C. In contrast, water is drawn through dewatering fabric 82 in the present invention, as shown in FIG. 8, preserving pillow areas C'. Pillow areas C' of FIG. 10, is an unpressed zone, which is supported on structured fabric 28, while pressed against Yankee 52. Pressed zone A' is the area through which most of the pressure applied is transferred. Pillow area C' has a higher basis weight than that of the illustrated prior art structures.

The increased mass ratio of the present invention, particularly in the pillow area, which carries more water than the compressed areas, results in at least two positive aspects of the present invention. First, it allows for a good transfer of the web to the Yankee surface at a lower overall sheet solid content than had been previously attainable. It is believed that the compressed areas are dryer than the pillow areas, thereby allowing an overall transfer of the web to another surface, such as a Yankee dryer, with a lower solids content. Secondly, the construct allows for the use of higher temperatures in the Yankee hood without scorching or burning of the pillow areas, which occurs in the prior art pillow areas. The Yankee hood temperatures are often greater than 350° C. and preferably greater than 450° C. and even more preferably greater than 550° C. As a result the present invention can operate at lower average pre-Yankee press solids than the prior art, making more full use of the capacity of the Yankee hood drying system.

Figure 12:
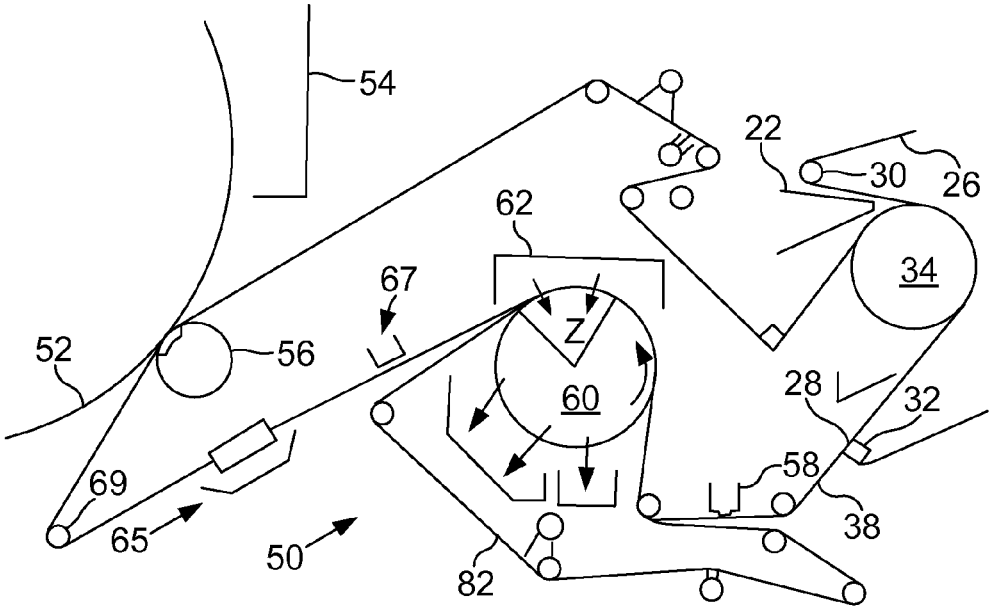
FIG. 12 illustrates a schematical cross-sectional view of an embodiment of a papermaking machine of the present invention.

Now, additionally referring to FIG. 12, there is shown an embodiment of the process where a structured fiber web 38 is formed. Structured fabric 28 carries a three dimensional structured web 38 to an advanced dewatering system 50, past suction box 65 and then to a Yankee roll 52 where the web is transferred to Yankee roll 52 and hood section 54 for additional drying and creeping before winding up on a reel (not shown).

A shoe press 56 is placed adjacent to structured fabric 28, holding it in a position proximate Yankee roll 52. Structured web 38 comes into contact with Yankee roll 52 and transfers to a surface thereof, for further drying and subsequent creping.

A vacuum box 58 is placed adjacent to structured fabric 28 to achieve a solids level of 15-25% on a nominal 20 gsm web running at −0.2 to −0.8 bar vacuum with a preferred operating level of −0.4 to −0.6 bar. Web 38, which is carried by structured fabric 28, contacts dewatering fabric 82 and proceeds toward vacuum roll 60. Vacuum roll 60 operates at a vacuum level of −0.2 to −0.8 bar with a preferred operating level of at least −0.4 bar. Hot air hood 62 is optionally fit over vacuum roll 60 to improve dewatering. The length of the vacuum zone inside the vacuum roll can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee roll 52. Wire turning roll 69 can also be a suction roll with a hot air supply hood. Roll 56 includes a shoe press with a shoe width of 80 mm or higher, preferably 120 mm or higher, with a maximum peak pressure of preferably less than 2.5 MPa. To create an even longer nip to facilitate the transfer of web 38 to Yankee 52, web 38 carried on structured fabric 28 can be brought into contact with the surface of Yankee roll 52 prior to the press nip associated with shoe press 56. Further, the contact can be maintained after structured fabric 28 travels beyond press 56.

Vacuum roll 60 has a roll thickness of between approximately 25 mm to 50 mm, but can also be thicker. The mean airflow speed through web 38 at vacuum roll 60 is approximately 6 m/s, but can vary according to the type of dewatering fabric, basis weight and/or furnish properties.

Figure 19:
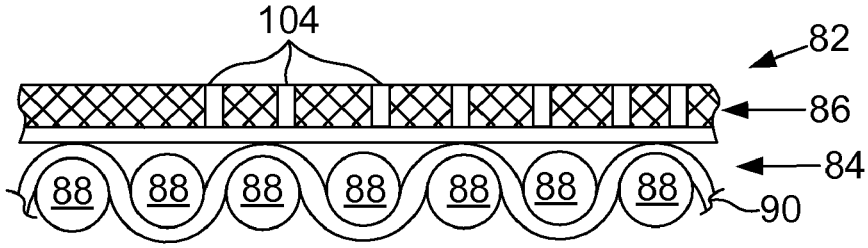
FIG. 19 is a cross-sectional schematic view of an embodiment of a dewatering fabric used in the machines of FIGS. 12-18.

Dewatering fabric 82 may have a permeable woven base fabric connected to a batt layer. The base fabric includes machine direction yarns and cross-directional yarns. FIG. 19 is a side illustration of a preferred embodiment of the present invention, included is a woven single layer base fabric 84. Base fabric 84 includes machine direction yarns 88 and cross direction yarns 90. Yarn 88 is a 3 ply multifilament twisted yarn. Yarn 90 is a monofilament yarn. Yarn 88 can also be a monofilament yarn and the construction can be of a typical multilayer design. In either case, base fabric 84 is needled with fine batt fiber 86 having a weight of less than or equal to 700 gsm, preferably less than or equal to 150 gsm and more preferably less than or equal to 135 gsm. The batt fiber encapsulated the base structure giving it sufficient stability. The needling process can be such that straight through channels are created. The sheet contacting surface is heated to improve its surface smoothness. The cross-sectional area of the machine direction yarns is larger than the cross-sectional area of the cross-direction yarns. The machine direction yarn is a multifilament yarn that may include thousands of fibers. The base fabric is connected to a batt layer by a needling process that results in straight through drainage channels.

In another embodiment of dewatering fabric 82 there is included a fabric layer, two batt layers, an anti-rewetting layer and an adhesive. The base fabric is substantially similar to the previous description. At least one of the batt layers include an adhesive to supplement fiber to fiber bonding. On one side of the base fabric, there is attached an anti-rewetting layer, which may be attached to the base fabric by an adhesive, a melting process or needling wherein the material contained in the anti-rewet layer is connected to the base fabric layer and a batt layer. The anti-rewetting layer is made of an elastomeric material thereby forming elastomeric membrane, which has openings therethrough.

The batt layers may be needled to thereby hold dewatering fabric 82 together. This advantageously leaves the batt layers with many needled holes therethrough. The anti-rewetting layer is porous having water channels or pores therethrough.

In yet an other embodiment of dewatering fabric 82, there is a construct substantially similar to that previously discussed with an addition of a hydrophobic layer to at least one side of de-watering fabric 82. The hydrophobic layer does not absorb water, but it does direct water through pores therein.

In yet another embodiment of dewatering fabric 82, the base fabric has attached thereto a lattice grid made of a polymer, such as polyurethane, that is put on top of the base fabric. The grid may be put on to the base fabric by utilizing various known procedures, such as, for example, an extrusion technique or a screen-printing technique. The lattice grid may be put on the base fabric with an angular orientation relative to the machine direction yarns and the cross direction yarns. Although this orientation is such that no part of the lattice is aligned with the machine direction yarns, other orientations can also be utilized. The lattice can have a uniform grid pattern, which can be discontinuous in part. Further, the material between the interconnections of the lattice structure may take a circuitous path rather than being substantially straight. The lattice grid is made of a synthetic, such as a polymer or specifically a polyurethane, which attaches itself to the base fabric by its natural adhesion properties.

In yet another embodiment of dewatering fabric 82 there is included a permeable base fabric having machine direction yarns and cross-direction yarns, that are adhered to a grid. The grid is made of a composite material the may be the same as that discussed relative to a previous embodiment of dewatering fabric 82. The grid includes machine direction yarns with a composite material formed therearound. The grid is a composite structure formed of composite material and machine direction yarns. The machine direction yarns may be pre-coated with a composite before being placed in rows that are substantially parallel in a mold that is used to reheat the composite material causing it to re-flow into a pattern. Additional composite material may be put into the mold as well. The grid structure, also known as a composite layer, is then connected to the base fabric by one of many techniques including laminating the grid to the permeable fabric, melting the composite coated yarn as it is held in position against the permeable fabric or by re-melting the grid onto the base fabric. Additionally, an adhesive may be utilized to attach the grid to permeable fabric.

The batt fiber may include two layers, an upper and a lower layer. The batt fiber is needled with the base fabric and the composite layer, thereby forming a dewatering fabric 82 having at least one outer batt layer surface. Batt material is porous by its nature, additionally the needling process not only connects the layers together, it also creates numerous small porous cavities extending into or completely through the structure of dewatering fabric 82.

Dewatering fabric 82 has an air permeability of from 5 to 100 cubic feet/minute preferably 19 cubic feet/minute or higher and more preferably 35 cubic feet/minute or higher. Pore diameters in dewatering fabric 82 are from 5 to 75 microns, preferably 25 microns or higher and more preferably 35 microns or higher. The hydrophobic layers can be made from a synthetic polymeric material, a wool or a polyarnide, for example, nylon 6. The anti-rewet layer and the composite layer may be made of a thin elastomeric permeable membrane made from a synthetic polymeric material or a polyarnide that is laminated to the base fabric.

The batt fiber layers are made from fibers ranging from 0.5 d-tex to 22 d-tex and may contain an adhesive to supplement fiber to fiber bonding in each of the layers. The bonding may result from the use of a low temperature meltable fiber, particles and/or resin.

Figure 13:
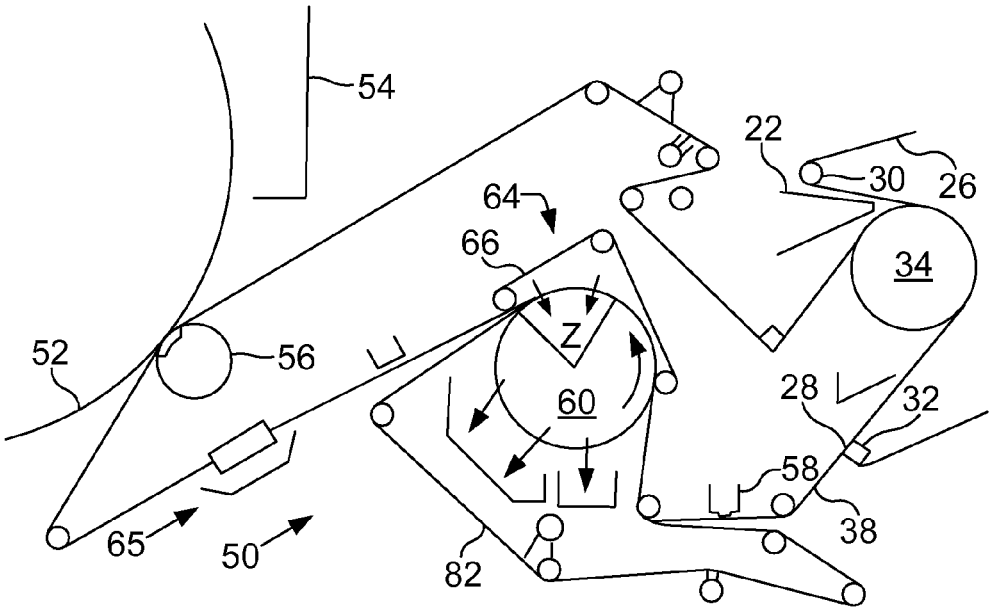
FIG. 13 illustrates a schematical cross-sectional view of another embodiment of a papermaking machine of the present invention.

Now, additionally referring to FIG. 13, there is shown yet another embodiment of the present invention, which is substantially similar to the invention illustrated in FIG. 12, except that instead of hot air hood 62, there is a belt press 64. Belt press 64 includes a permeable belt 66 capable of applying pressure to the non-sheet contacting side of structured fabric 28 that carries web 38 around suction roll 60. Fabric 66 of belt press 64 is also known as an extended nip press belt or a link fabric, which can run at 60 KN/m with a pressing length that is longer than the suction zone of roll 60. While pressure is applied to structured fabric 28, the high fiber density pillow areas in web 38 are protected from that pressure as they are contained within the body of structured fabric 28.

Belt 66 is a specially designed Extended Nip Press Belt 66, made of, for example reinforced polyurethane and/or a spiral link fabric. Belt 66 is permeable thereby allowing air to flow therethrough to enhance the moisture removing capability of belt press 64. Moisture is drawn from web 38 through dewatering fabric 82 and into vacuum roll 60.

Belt 66 provides a low level of pressing in the range of 50-300 KPa and preferably greater than 100 KPa. This allows a suction roll with a 1.2 meter diameter to have a fabric tension of greater than 30 KN/m and preferably greater than 60 KN/m. The pressing length of permeable belt 66 against fabric 28, which is indirectly supported by vacuum roll 60, is at least as long as a suction zone in roll 60. Although the contact portion of belt 66 can be shorter than the suction zone.

Permeable belt 66 has a pattern of holes therethrough, which may, for example, be drilled, laser cut, etched formed or woven therein. Permeable belt 66 may be monoplanar without grooves. In one embodiment, the surface of belt 66 has grooves and is placed in contact with fabric 28 along a portion of the travel of permeable belt 66 in belt press 64. Each groove connects with a set of the holes to allow the passage and distribution of air in belt 66. Air is distributed along the grooves, which constitutes an open area adjacent to contact areas, where the surface of belt 66 applies pressure against web 38. Air enters permeable belt 66 through the holes and then migrates along the grooves, passing through fabric 28, web 38 and fabric 82. The diameter of the holes may be larger than the width of the grooves. The grooves may have a cross-section contour that is generally rectangular, triangular, trapezoidal, semi-circular or semi-elliptical. The combination of permeable belt 66, associated with vacuum roll 60, is a combination that has been shown to increase sheet solids by at least 15%.

An example of another structure of belt 66 is that of a thin spiral link fabric, which can be a reinforcing structure within belt 66 or the spiral link fabric will itself serve as belt 66. Within fabric 28 there is a three dimensional structure that is reflected in web 38. Web 38 has thicker pillow areas, which are protected during pressing as they are within the body of structured fabric 28. As such the pressing imparted by belt press assembly 64 upon web 38 does not negatively impact web quality, while it increases the dewatering rate of vacuum roll 60.

Figure 14:
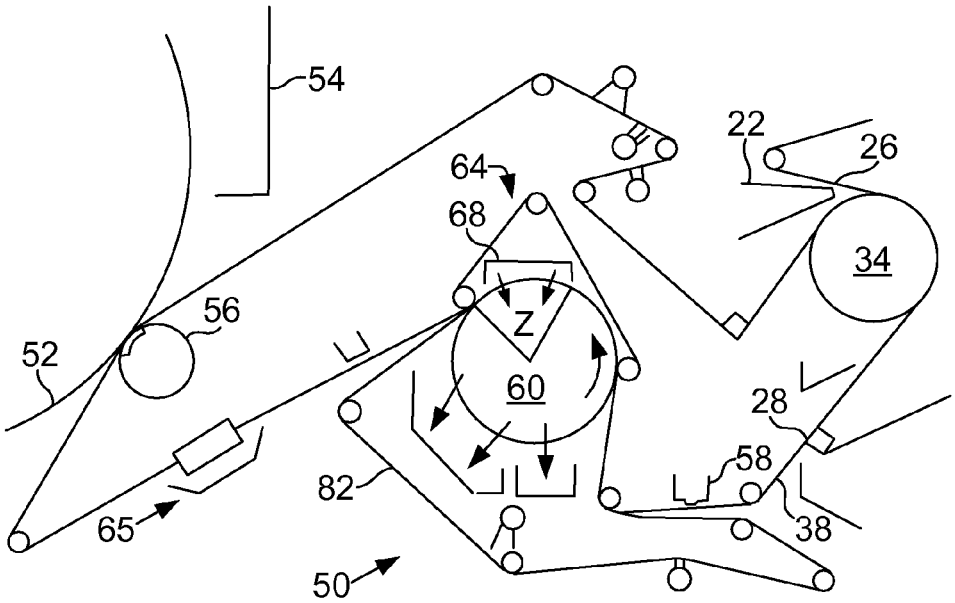
FIG. 14 illustrates a schematical cross-sectional view of another embodiment of a papermaking machine of the present invention.

Now, additionally referring to FIG. 14, which is substantially similar to the embodiment shown in FIG. 13 with the addition of hot air hood 68 placed inside of belt press 64 to enhance the dewatering capability of belt press 64 in conjunction with vacuum roll 60.

Figure 15:
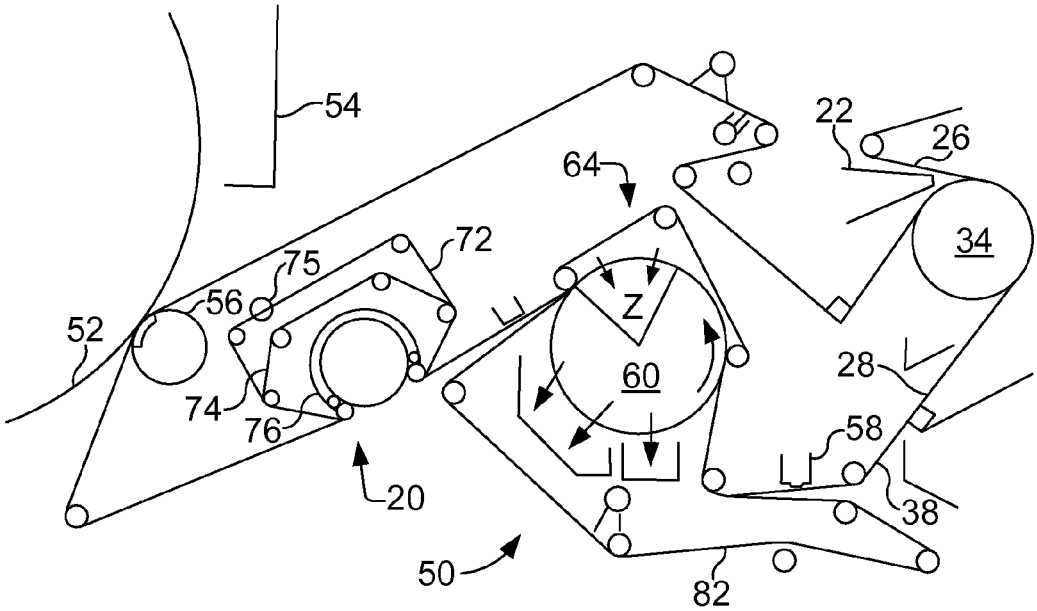
FIG. 15 illustrates a schematical cross-sectional view of another embodiment of a papermaking machine of the present invention.

Now, additionally referring to FIG. 15, there is shown yet another embodiment of the present invention, which is substantially similar to the embodiment shown in FIG. 13, but including a boost dryer 70, which encounters structured fabric 28. Web 38 is subjected to a hot surface of boost dryer 70, structure web 38 rides around boost dryer 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. Here again, the higher fiber density pillow areas in web 38 are protected from the pressure as they are contained within the body of structured fabric 28. As such, the pressing process does not negatively impact web quality. The drying rate of boost dryer 70 is above 400 $kg/hrm^2$ and preferably above 500 $kg/hrm^2$. The concept of boost dryer 70 is to provide sufficient pressure to hold web 38 against the hot surface of the dryer thus preventing blistering. Steam that is formed at the knuckle points fabric 28 passes through fabric 28 and is condensed on fabric 72. Fabric 72 is cooled by fabric 74 that is in contact with the cooling jacket, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending upon the size of boost dryer 70, web 38 may be creped on the surface of boost dryer 70, thereby eliminating the need for Yankee dryer 52.

Figure 16:
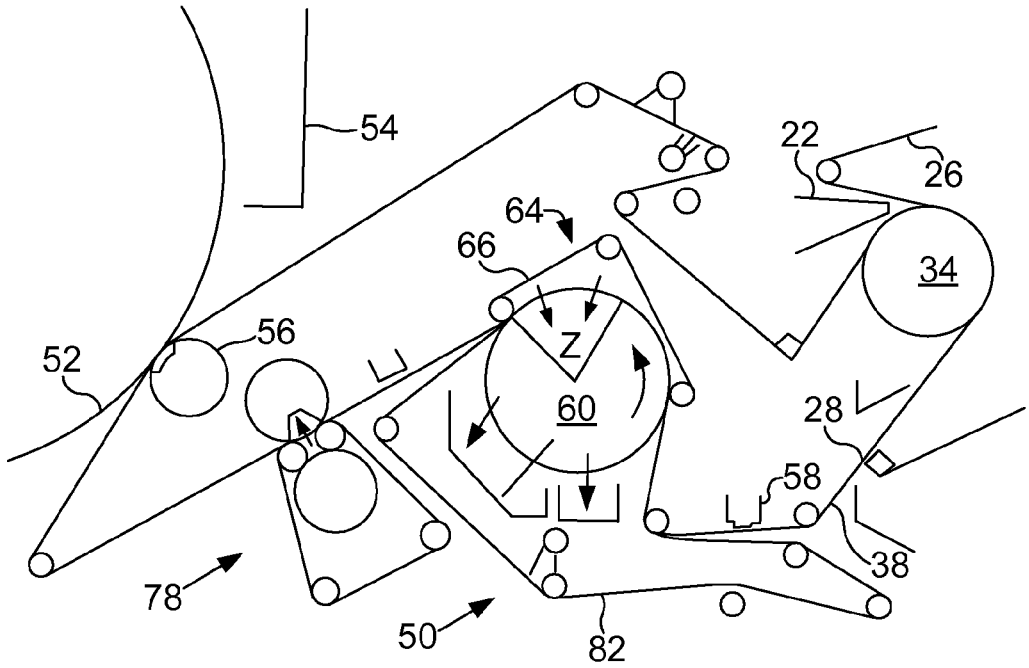
FIG. 16 illustrates a schematical cross-sectional view of another embodiment of a papermaking machine of the present invention.

Now, additionally referring to FIG. 16, there is shown yet another embodiment of the present invention substantially similar to the invention disclosed in FIG. 13 but with an addition of an air press 78, which is a four roll cluster press that is used with high temperature air and is referred to as a High Pressure Through Air Dryer ("HPTAD") for additional web drying prior to the transfer of web 38 to Yankee 52. Four roll cluster press 78 includes a main roll and a vented roll and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high pressure hot air passes through an optional air dispersion fabric, through web 38 and fabric 28 into a vent roll. The air dispersion fabric may prevent web 38 from following one of the four cap rolls. The air dispersion fabric is very open, having a permeability that equals or exceeds that of fabric 28. The drying rate of the HPTAD depends on the solids content of web 38 as it enters the HPTAD. The preferred drying rate is at least 500 $kg/hr/m^2$, which is a rate of at least twice that of conventional TAD machines.

Advantages of the HPTAD process are in the areas of improved sheet dewatering without a significant loss in sheet quality, compactness in thickness and energy efficency. Additionally, it enables higher pre-Yankee solids, which increase the speed potential of the invention. Further, the compact size of the HPTAD allows easy retrofit to an existing machine. The compact size of the HPTAD and the fact that it is a closed system means that it cam be easily insulated and optimized as a unit to increase energy efficiency.

Figure 17:
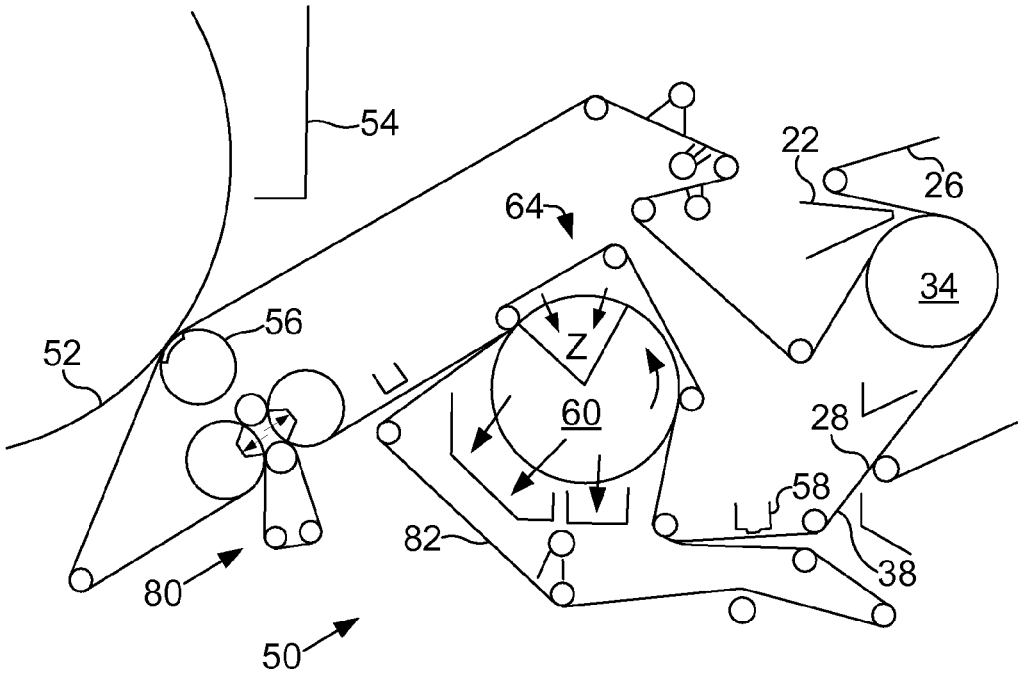
FIG. 17 illustrates a schematical cross-sectional view of another embodiment of a papermaking machine of the present invention.

Now, additionally referring to FIG. 17, there is shown another embodiment of the present invention. This is significantly similar to FIGS. 13 and 16 except for the addition of a two-pass HPTAD 80. In this case, two vented rolls are used to double the dwell time of structured web 38 relative to the design shown in FIG. 16. An optional air dispersion fabric may used as in the previous embodiment. Hot pressurized air passes through web 38 carried on fabric 28 and onto the two vent rolls. It has been shown that depending on the configuration and size of the HPTAD, that more than one HPTAD can be placed in series, which can eliminate the need for roll 60.

Figure 18:
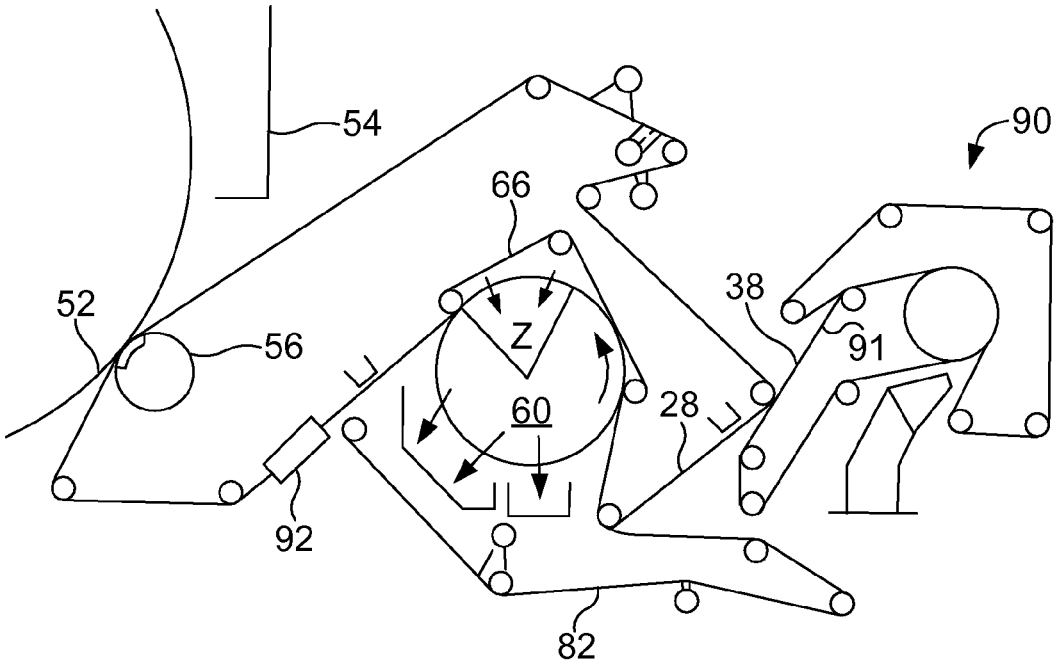
FIG. 18 illustrates a schematical cross-sectional view of another embodiment of a papermaking machine of the present invention.

Now, additionally referring to FIG. 18, a conventional Twin Wire Former 90 may be used to replace the Crescent Former shown in previous examples. The forming roll can be either a solid or open roll. If an open roll is used, care must be taken to prevent significant dewatering through the structured fabric to avoid losing fiber density in the pillow areas. The out forming fabric can be either a standard forming fabric or one such as that disclosed in U.S. Pat. No. 6,237,644. The inner forming fabric 91 is a structured fabric 91 that is much coarser than the outer forming fabric. Web 38 is transferred to structured fabric 28 using a vacuum device. The transfer can be a stationary vacuum shoe or a vacuum assisted rotating pick-up roll. The second structured fabric 28 is at least the same coarseness and preferably courser than first structured fabric 91. The process from this point is the same as one of the previously discussed processes. The registration of the web from the first structured fabric to the second structured fabric is not perfect, as such some pillows will be pressed, losing some of the benefit of the present invention. However, this process option allows for running a differential speed transfer, which has been shown to improve some sheet properties. Any of the arrangements for removing water discussed above and a conventional TAD 92 may be used with the Twin Wire Former arrangement.

Fabric 26 may be uniformly permeable or have a pattern of non-permeable portions, which serve to enhance a pattern in web 38. The depth of the patterns can be adjusted differently for different tissue products. Pattern portions are also referred to as having zones of differing permeability.

The fiber density distribution of web 38 in this invention is opposite that of the prior art, which is a result of removing moisture through the forming fabric and not through the structured fabric. This allows a high percentage of the fibers to remain uncompressed during the process. The sheet absorbency capacity as measured by the basket method, for a nominal 20 gsm web is equal to or greater than 12 grams of water per gram of fiber and often exceeds 15 grams of water per gram fiber. The sheet bulk is equal to or greater than 10 $cm^3/gm$ and preferably greater than 13 $cm^3/gm$. The sheet bulk of toilet tissue is expected to be equal to or greater than 13 $cm^3/gm$ before calendering.

With the basket method of measuring absorbency, five (5) grams of paper are placed into a basket. The basket containing the paper is then weighted and introduced into a small vessel of water at 20° C. for 60 seconds. After 60 seconds of soak time, the basket is removed from the water and allowed to drain for 60 seconds and then weighted again. The weight difference is then divided by the paper weight to yield the grams of water held per gram of fibers being absorbed and held in the paper.

Web 38 is formed from fibrous slurry 24 that headbox 22 discharges between forming fabric 26 and structured fabric 28. Roll 34 rotates and supports fabrics 26 and 28 as web 38 forms. Moisture M flows through fabric 26 and is captured in save all 36. It is the removal of moisture in this manner that serves to allow pillow areas of web 38 to retain a greater thickness than if the moisture were to be removed through structured fabric 28. Sufficient moisture is removed from web 38 to allow fabric 26 to be removed from web 38 to allow web 38 to proceed to a drying stage. Web 38 retains the pattern of structured fabric 28 and any zonal permeability effects from fabric 26 that may be present.

Now, additionally referring to FIGS. 19-24, there are shown several embodiments of dewatering fabric 82 of the present invention. In FIG. 19, there is shown dewatering fabric 82 having a permeable woven base fabric 84 connected to a batt layer 86. Fabric 84 includes machine direction yarns 88 and cross-directional yarns 90. Machine direction yarns 88 may have a count of approximately 1,060/meter and cross-directional yarns may have a count of approximately 520/meter. Dewatering fabric 82, illustrated in FIG. 19, is a side illustration of a preferred embodiment of the present invention, included is a woven single layer base fabric 84. Base fabric 84 includes machine direction yarns 88 and cross direction yarns 90. Yarn 88 is a 3 ply multifilament twisted yarn. Yarn 90 is a monofilament yarn. Yarn 88 can also be a monofilament yarn and the construction can be of a typical multilayer design. In either case, base fabric 84 is needled with fine batt fiber 86 having a weight of less than or equal to 700 gsm, preferably less than or equal to 150 gsm and more preferably less than or equal to 135 gsm. The batt fiber encapsulated the base structure giving it sufficient stability. The needling process can be such that straight through channels are created. The sheet contacting surface is heated to improve its surface smoothness. The cross-sectional area of machine direction yarns 88 is larger than the cross-sectional area of cross-direction yarns 90. Machine direction yarn 88 is a multifilament yarn that may include thousands of fibers. Base fabric 84 is connected to batt layer 86 by a needling process that results in straight through drainage channels 104.

Figure 20:
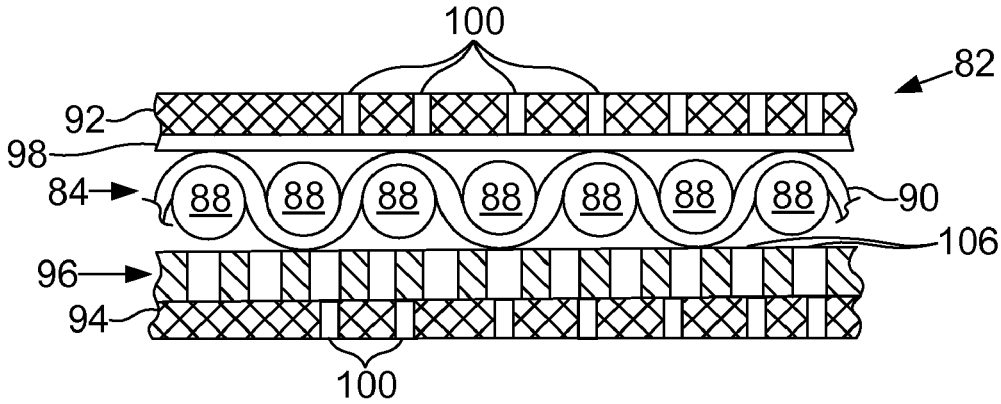
FIG. 20 is a cross-sectional schematic view of another embodiment of a dewatering fabric used in the machines of FIGS. 12-18.

In FIG. 20, there is shown another embodiment of the present invention including a fabric layer 84, batt layer 92, batt layer 94, anti-rewetting layer 96 and adhesive 98. Fabric 84 is substantially similar to fabric 84 of FIG. 20. Batt layer 92 includes an adhesive 98 to supplement fiber to fiber bonding. Batt layer 92 may be substantially similar to batt layer 94. On another side of fabric 84, there is attached anti-rewetting layer 96 which may be attached to fabric 84 by adhesive, a melting process or needling whereby the material contained in layer 96 is connected to fabric layer 84 and batt layer 94. Anti-rewetting layer 96 is made of an elastomeric material thereby forming elastomeric membrane 96, which has openings therethrough.

Batt layers 92 and 94 may be needled to thereby hold dewatering fabric 82 together. This advantageously leaves Batt layers 92 and 94 with many needled holes 100 therethrough. Layer 96 is a porous anti-rewetting layer 96 having water channels or pores 106 therethrough.

Figure 21:
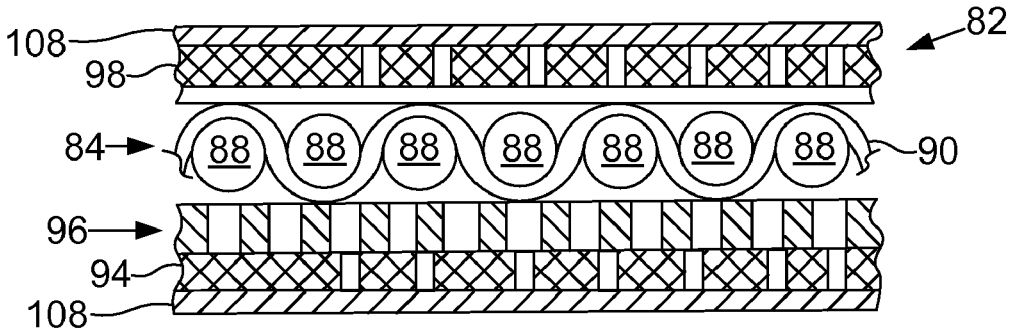
FIG. 21 is a cross-sectional schematic view of yet another embodiment of a dewatering fabric used in the machines of FIGS. 12-18.

In FIG. 21, there is shown a construct substantially similar to that shown in FIG. 21 with an addition of a hydrophobic layer 108 to at least one side of de-watering fabric 82. De-watering fabric 82 is also described as a permeable membrane 82. Hydrophobic layer 108 does not absorb water, but it does direct water through pores therein.

Figure 22:
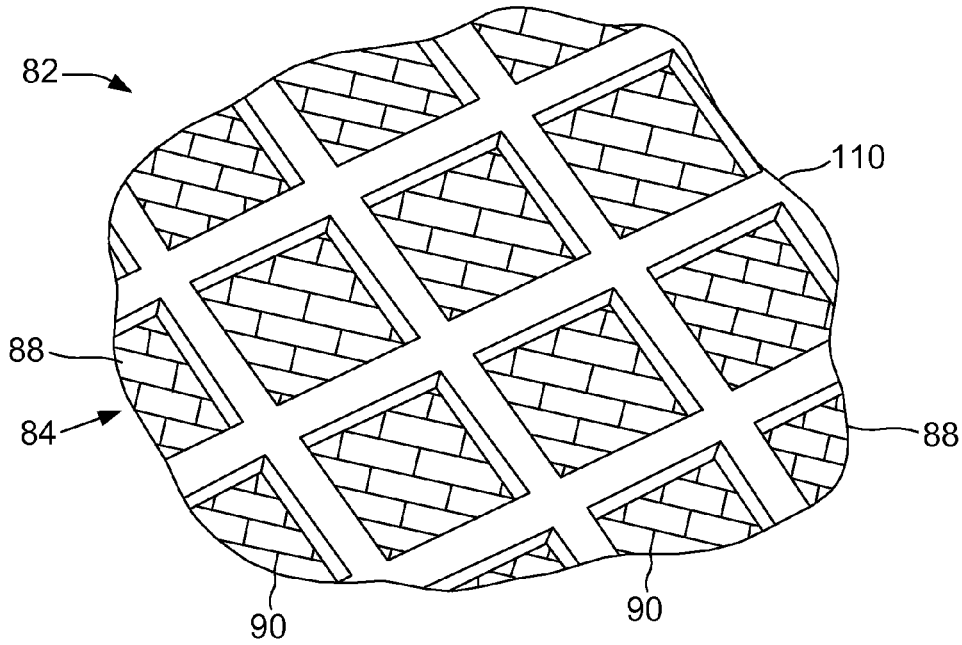
FIG. 22 is a perspective view of yet another embodiment of a dewatering fabric used in the machines of FIGS. 12-18.

Now, additionally referring to FIG. 22 there is illustrated another embodiment of dewatering fabric 82. In this embodiment, base fabric 84 has attached thereto a lattice grid 110 made of a polymer, such as polyurethane, that is put on top of base fabric 84. The side of dewatering fabric 82 that runs against a roll is illustrated in FIG. 22. The opposite side of dewatering fabric 82 (not shown), which is an opposite side of base fabric 84, is the side that contacts web 38. Grid 110 may be put on base fabric 84 by utilizing various known procedures, such as, for example, an extrusion technique or a screen-printing technique. As shown in FIG. 22, lattice 110 is put on base fabric 84 with an angular orientation relative to machine direction yarns 88 and cross direction yarns 90. Although this orientation is such that no part of lattice 110 is aligned with machine direction yarns 88 as shown in FIG. 22, other orientations such as that shown in FIG. 23 can also be utilized. Although lattice 110 is shown as a rather uniform grid pattern, this pattern can actually be discontinuous in part. Further, the material between the interconnections of the lattice structure may take a circuitous path rather than being substantially straight, as that shown in FIG. 22. Lattice grid 110 is made of a synthetic, such as a polymer or specifically a polyurethane, which attaches itself to base fabric 84 by its natural adhesion properties.

Figure 23:
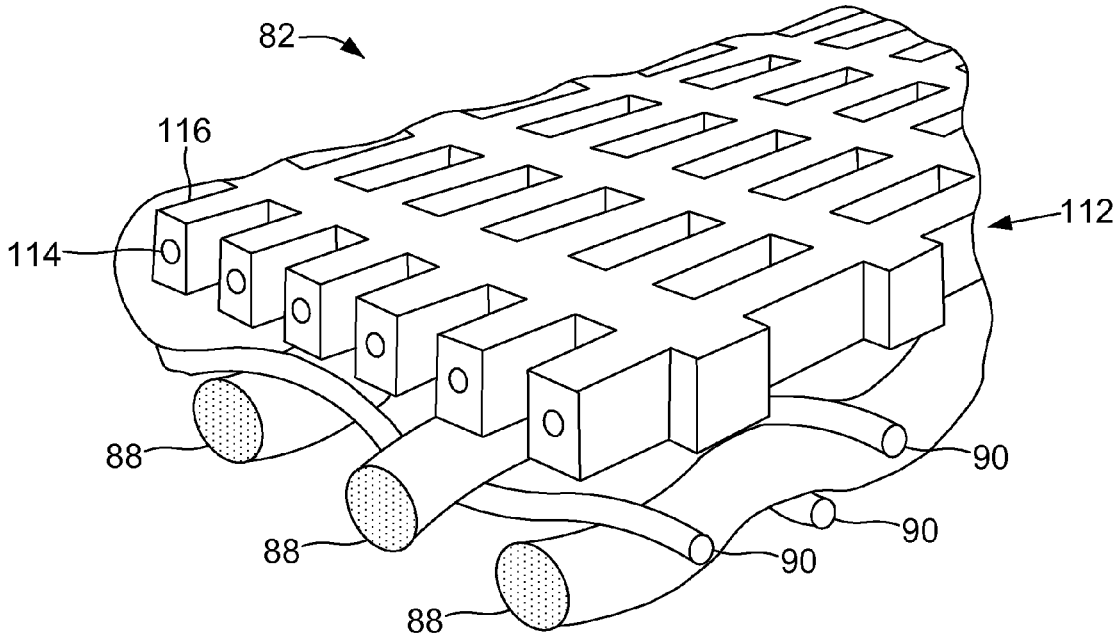
FIG. 23 is a sectioned perspective view of yet another embodiment of a dewatering fabric used in the machines of FIGS. 12-18.

Now, additionally referring to FIG. 23, there is shown yet another embodiment of dewatering fabric 82 including permeable base fabric 84 having machine direction yarns 88 and cross-direction yarns 90, that are adhered to grid 112. Grid 112 is made of a composite material the may be the same as that used in lattice grid 110. Grid 112 includes machine direction yarns 114 and a composite material 116 formed therearound. Grid 112 is a composite structure formed of composite material 116, and machine direction yarn 114. Machine direction yarn 114 may be pre-coated with composite 116 before being placed in rows that are substantially parallel in a mold that is used to reheat composite material 116 causing it to re-flow into the pattern shown as grid 112 in FIG. 24. Additional composite material 116 may be put into the mold as well. Grid structure 112, also known as composite layer 112, is then connected to base fabric 84 by one of many techniques including laminating grid 112 to permeable fabric 84, melting composite coated yarn 114 as it is held in position against permeable fabric 84 or by re-melting grid 112 onto base fabric 84. Additionally, an adhesive may be utilized to attach grid 112 to permeable fabric 84.

Figure 24:
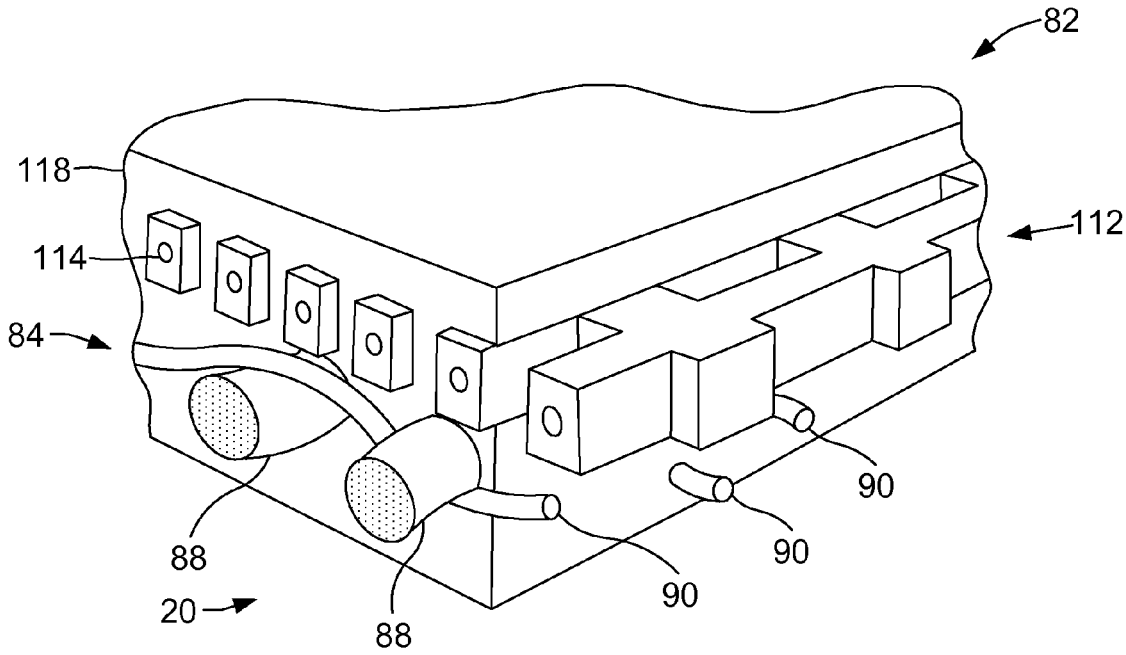
FIG. 24 is a sectioned perspective view of still yet another embodiment of a dewatering fabric used in the machines of FIGS. 12-18.
Figure 25:
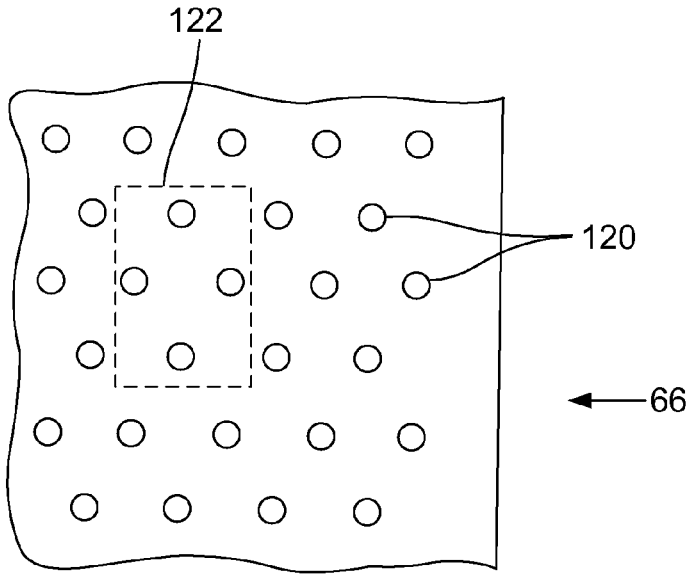
FIG. 25 is a surface view of one side of a permeable belt of the belt press used in the machines of FIGS. 13-18.
Figure 26:
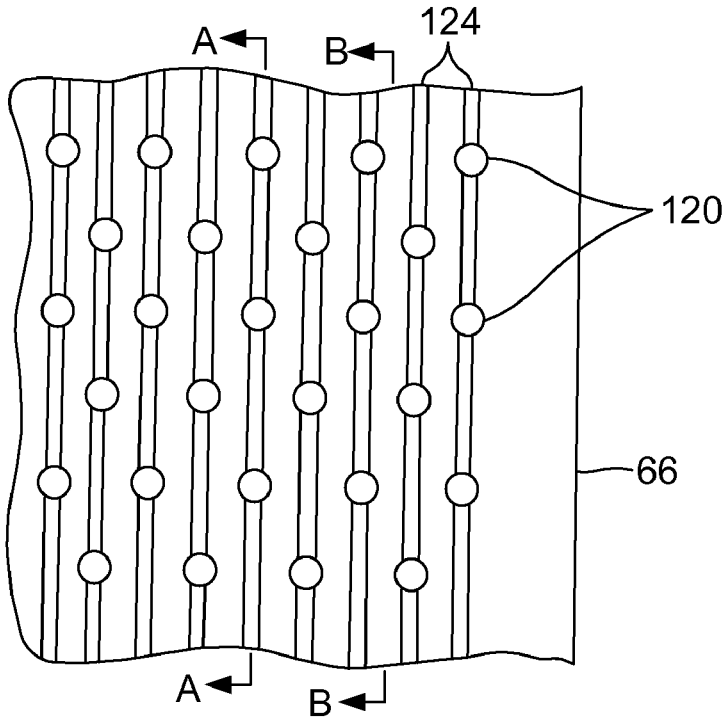
FIG. 26 is a view of an opposite side of the permeable belt of FIG. 25.
Figure 27:
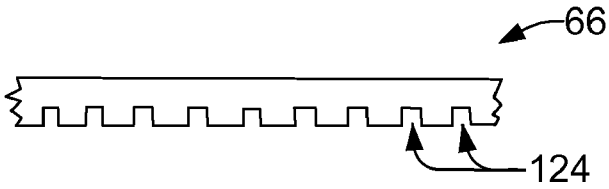
FIG. 27 is cross-sectional view of the permeable belt of FIGS. 25 and 26.
Figure 28:
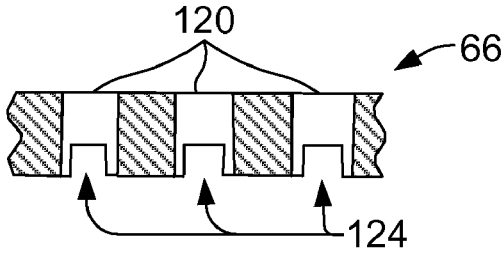
FIG. 28 is an enlarged cross-sectional view of the permeable belt of FIGS. 25-27.

Now, additionally referring to FIG. 24, there is shown a structure that includes the elements that are shown in FIG. 23 with the addition of batt fiber 118. Batt fiber 118 may include two layers, an upper and a lower layer. Batt fiber 118 is needled with base fabric 84 and composite layer 112, thereby forming a dewatering fabric 82 having at least one outer batt layer surface. This is similar to the cross-sectional representation shown in FIG. 20 with relatively thin batt layers utilized to form batt fibers 118, which are needled together, forming dewatering fabric 82. Batt material 118 is porous by its nature, additionally the needling process not only connects the layers together, it also creates numerous small porous cavities extending into or completely through the structure of dewatering fabric 82.

Dewatering fabric 82 has an air permeability of from 5 to 100 cubic feet/minute preferably 19 cubic feet/minute or higher and more preferably 35 cubic feet/minute or higher. Pore diameters 100, 68 and/or 106 are from 5 to 75 microns, preferably 25 microns or higher and more preferably 35 microns or higher. Hydrophobic layers 108 can be made from a synthetic polymeric material, a wool or a polyamide, for example, nylon 6. Anti-rewet layer 96 and composite layer 112 may be made of a thin elastomeric permeable membrane made from a synthetic polymeric material or a polyamide that is laminated to fabric 84. Layer 96 is preferably equal to or less than 1.05 millimeters thick.

Batt fiber layers 86, 92, 94 and 118 are made from fibers ranging from 0.5 d-tex to 22 d-tex and may contain an adhesive to supplement fiber to fiber bonding in each of layers 86, 92, 94 and 118. The bonding may result from that makes use of, for example, a low temperature meltable fiber, particles and/or resin. The overall thickness of dewatering fabric 82 is less than 2.0 millimeters, preferably less than 1.50 millimeters, and preferably less than 1.25 millimeters and more preferably less than 1.0 millimeter thick. Machine direction yarns 88, also known as weft yarns 88, are made of a multi-filament yarn, normally twisted/plied or can be a solid monolithic strand usually of less than 0.30 millimeter diameter, with a preferable diameter of 0.20 millimeter or as low as 0.10 millimeter. The fibers are formed in a single strand, twisted cabled or joined side by side to form a flat shaped fabric 84. Woven permeable fabric 84 may have openings 100 of layers 92 and 94, punched with through fabric 84 as well thereby causing a straight through drainage channel 100 through dewatering fabric 82. Additionally, a hydrophobic layer 108 may be applied to at least one surface.

As to the uses of dewatering fabric 82 in paper machine 50, pressure is applied by belt press 64 against web 38 as a mechanical force that creates a hydraulic pressure in the moisture contained in web 38. The squeezing action is coupled with a vacuum in vacuum roll 60, to drive moisture from web 38 and through de-watering permeable membrane 82. Advantageously, moisture is removed through the combination of the pressure applied by the extended nip press contact of belt 66 and the introduction of air through belt 66, fabric 28 and dewatering fabric 82 enhance the dewatering capability of the present invention.

Now, additionally referring to FIGS. 25-28 there are shown details of permeable belt 66 of belt press 64 having holes 120 therethrough, holes 120 are arranged in a hole pattern 122 and grooves 124 are located on one side of belt 66. Permeable belt 66 is routed so as to engage a surface of fabric 28 and thereby press fabric 28 further against web 38, and web 38 against dewatering fabric 82, which is supported thereunder by vacuum roll 60. As this temporary coupling around vacuum roll 60 continues in direction W, it encounters a vacuum zone Z causing air to be passed through permeable belt 66, fabric 28, drying web 38 and the moisture picked up by the airflow proceeds further through dewatering fabric 82 and through a porous surface of vacuum roll 60. Moisture directed into vacuum roll 60 is also captured by save alls located beneath vacuum roll 60. As web 38 leaves belt press 64, dewatering fabric 82 is separated from web 38, and web 38 continues with fabric 28 past a pick up vacuum, which additionally suctions moisture from fabric 28 and web 38.

Fabric 82 proceeds past showers, which apply moisture to fabric 82 to clean fabric 82. Fabric 82 then proceeds past a Uhle box, which removes moisture from fabric 82.

Now, additionally referring to FIGS. 29-33, there is further illustrated embodiments of permeable belt 66, that may be an extended nip press belt 66 made of a flexible reinforced polyurethane 126 and/or a spiral link fabric 132. Permeable belt 66 provides a low level of pressing in the range of 50-300 KPa and preferably greater than 100 KPa. This allows a suction roll with a 1.2 meter diameter to have a fabric tension of greater than 30 KN/m and preferably greater than 60 KN/m. The pressing length of permeable belt 66 against fabric 28, which is indirectly supported by vacuum roll 60, is at least as long as suction zone Z in roll 60. Although the contact portion of permeable belt 66 can be shorter than suction zone Z.

Permeable belt 66 has a pattern 122 of holes 120 therethrough, which may, for example, be drilled, laser cut, etched, formed or woven therein. Permeable belt 66 may be monoplanar without the grooves shown in FIGS. 26-28. A surface of permeable belt 66 having grooves 124 is placed in contact with fabric 28 along a portion of the travel of permeable belt 66 in belt press 64. Each groove 124 connects with a set of holes 120 to allow the passage and distribution of air in belt 66. Air is distributed along grooves 124, which constitutes an open area adjacent to contact areas, where the surface of belt 66 applies pressure against web 38. Air enters permeable belt 66 through holes 120 and then migrates along grooves 124 passing through fabric 28, web 38 and dewatering fabric 82. The diameter of holes 120 is larger than the width of grooves 124. Although grooves 124 are shown having a generally rectangular cross-sectional, grooves 124 may have a different cross-section contour, such as, triangular, trapezoidal, semi-circular or semi-elliptical.

Permeable belt 66 is capable of running at high running tensions of at least 30 KN/m or 60 KN/m or higher with a relatively high surface contact area of 25% or greater and a high open area of 25% or greater. The composition of permeable belt 66 may include a thin spiral link having a support layer within permeable belt 66.

The circumferential length of vacuum zone Z can be from 200 mm to 2,500 mm, with a preferable length of 300 mm-1,200 mm, and an even more preferable length of 400 mm-800 mm. The solids leaving vacuum roll 60 in web 38 will vary between 25% to 55% depending on the vacuum pressures and the tension on permeable belt as well as the length of vacuum zone Z and the dwell time of web 38 in vacuum zone Z.

Figure 30:
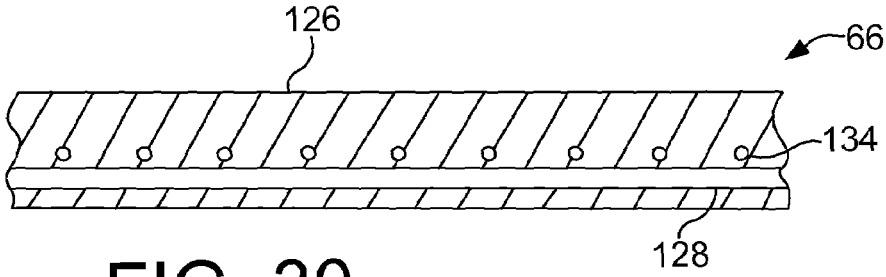
FIG. 30 is another cross-sectional view of the permeable belt of FIG. 26, taken along B-B of FIG. 26.
Figure 29:
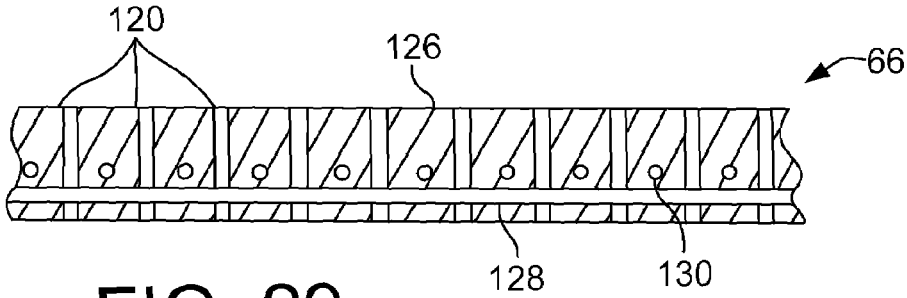
FIG. 29 is a cross-sectional view of the permeable belt of FIG. 26, taken along A-A of FIG. 26.

In one embodiment of permeable belt 66, as illustrated in FIGS. 29 and 30, a polyurethane matrix 126 has a permeable structure in the form of a woven structure with reinforcing machine direction yarns 128 and cross direction yarns 130 at least partially embedded within polyurethane matrix 126.

Figure 32:
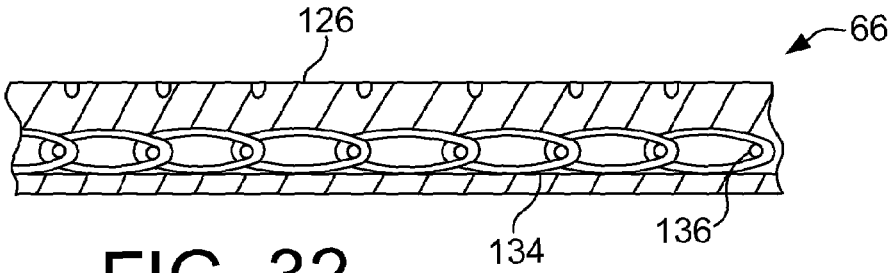
FIG. 32 is a cross-sectional view of another embodiment of the permeable belt of FIG. 26, taken along B-B of FIG. 26.
Figure 31:
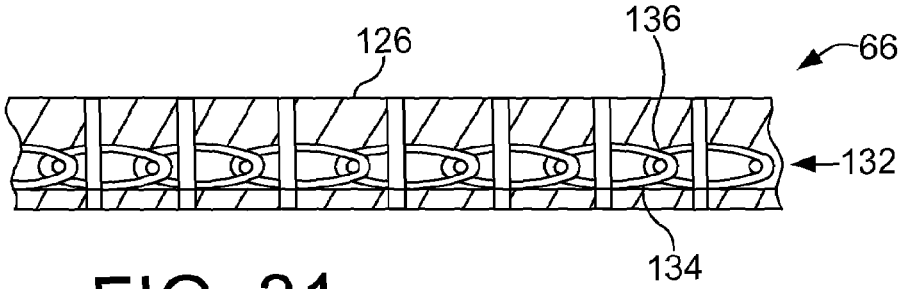
FIG. 31 is a cross-sectional view of another embodiment of the permeable belt of FIG. 26, taken along A-A of FIG. 26.

In another embodiment of permeable belt 66, as illustrated in FIGS. 31 and 32, a polyurethane matrix 126 has a permeable structure in the form of a spiral link fabric 132 at least partially embedded within polyurethane matrix 126. Holes 120 extend through belt 66 and may at least partially sever portions of spiral link fabric 132.

Figure 33:
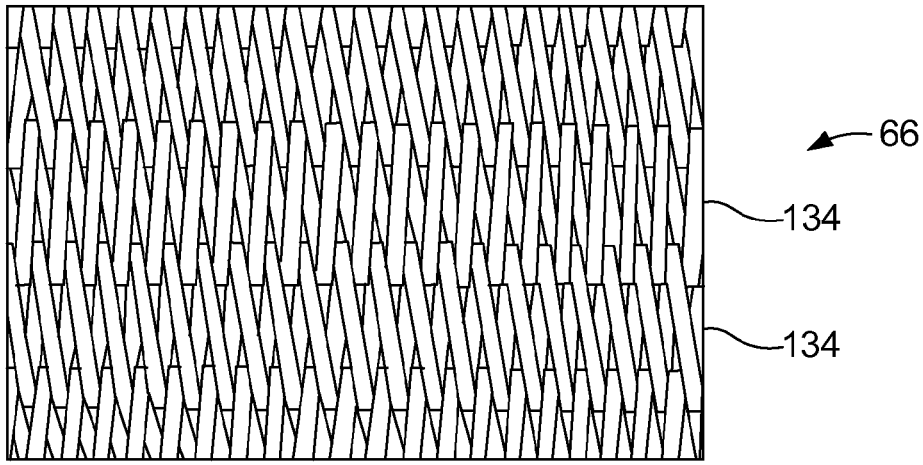
FIG. 33 is a surface view of another embodiment of the permeable belt of the present invention.
Figure 34:
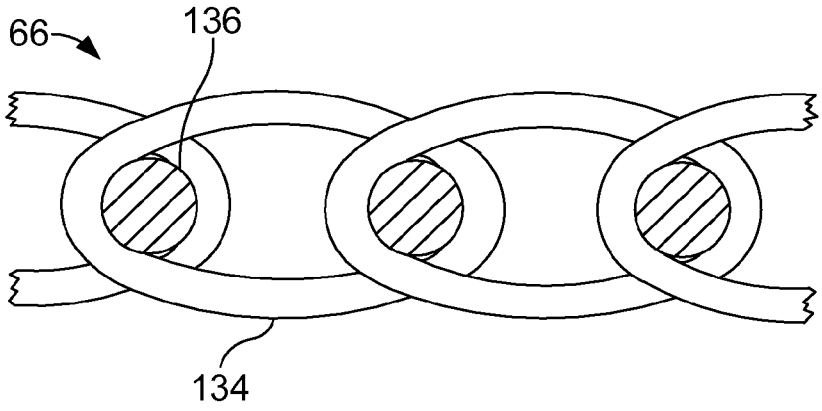
FIG. 34 is a side view of a portion of the permeable belt of FIG. 33.

In yet another embodiment of permeable belt 66, as illustrated in FIGS. 33 and 34, yarns 134 are interlinked by the entwining of generally spiral woven yarns 134 with cross yarns 136 to form link fabric 132.

Permeable belt 66 is capable of applying a line force over an extremely long nip, thereby ensuring a long dwell time in which pressure is applied against web 38 as compared to a standard shoe press. This results in a much lower specific pressure, thereby reducing the sheet compaction and enhancing sheet quality. The present invention further allows for a simultaneous vacuum and pressing dewatering with airflow through the web at the nip itself.

Advanced dewatering system 50 utilizes belt press 64 to remove part of the water from web 38. The physical pressure applied by belt 66 places some hydraulic pressure on the water in web 38 causing it to migrate toward fabrics 28 and 82 and even into grooves 124. As this coupling of web 38 with fabrics 28 and 82, and belt 66 continues around vacuum roll 60 in machine direction W, it encounters a vacuum zone Z through which air is passed through permeable belt 66, fabric 28, thereby drying web 38 and the moisture picked up by the airflow proceeds further through dewatering fabric 82 and through a porous surface of vacuum roll 60. Drying air that passes through holes 120 is distributed along grooves 124 before passing through fabric 28. As web 38 leaves belt press 64, belt 66 separates from fabric 28. Shortly thereafter dewatering fabric 82 separates from web 38, and web 38 continues with fabric 28 past a pick up vacuum, which additionally suctions moisture from fabric 28 and web 38. Web 38 is further dried by the use of a Yankee roll 52, a suction roll 56, a hot air hood 68, a boost dryer 70, an HPTAD 78 and/or a two pass HPTAD 80.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of dewatering a fibrous web in a paper machine, comprising the steps of:

carrying the fibrous web on a side of a first fabric;

contacting an other side of said first fabric with an extended nip press belt, said extended nip press belt being permeable;

contacting the fibrous web with a side of a second fabric, the fibrous web being between said first fabric and said second fabric, said first fabric being between said extended nip press belt and the fibrous web; and passing air successively through said extended nip press belt, said first fabric, the fibrous web and said second fabric.

2. The method of claim 1, wherein said first fabric is a structured fabric and said second fabric is a dewatering fabric.

3. The method of claim 2, wherein said structured fabric includes a plurality of valleys and a plurality of peaks.

4. The method of claim 2, wherein said dewatering fabric includes:

a woven permeable fabric;

a polymeric layer having openings therethrough, said polymeric layer connected to said permeable fabric; and at least one batt layer needled to said permeable fabric and said polymeric layer, thereby connecting said permeable fabric and said polymeric layer.

5. The method of claim 4, wherein said dewatering fabric further comprises at least one anti-rewet layer attached to at least one of said permeable fabric and said at least one batt fiber.

6. The method of claim 5, wherein said anti-rewet layer is an elastomeric membrane.

7. The method of claim 6, wherein said elastomeric membrane is less than approximately 1.05 mm thick.

8. The method of claim 4, wherein said dewatering fabric further comprises an anti-rewet layer having a first side and a second side, said first side attached to said permeable fabric, said at least one batt fiber layer includes an other batt fiber layer connected to said second side.

9. The method of claim 8, wherein said anti-rewet layer includes pores therethrough.

10. The method of claim 9, wherein said pores have a mean pore diameter in the range of approximately 5 microns to approximately 75 microns.

11. The method of claim 1, wherein said passing step is accomplished by at least one of the steps of:

placing a negative air pressure on an other side of said second fabric; and placing a positive air pressure on an other side of said first fabric.

12. The method of claim 11, wherein only said placing a negative air pressure step is executed.

13. The method of claim 12, wherein said placing a negative air pressure step is applied by a vacuum roll.

14. The method of claim 13, further comprising the step of applying a vacuum of between approximately −0.2 bar to approximately −0.8 bar by way of said vacuum roll.

15. The method of claim 13, further comprising the step of applying a vacuum of at least −0.4 bar.

16. The method of claim 1, further comprising the step of conveying said first fabric with the fibrous web to at least one of a Yankee roll, a suction roll, a hot air hood, a boost dryer, an air press, a High Pressure Through Air Dryer and a two pass High Pressure Through Air Dryer.

17. The method of claim 16, wherein said conveying step is conveying said first fabric with the fibrous web to said Yankee roll.

18. A method of manufacturing a fibrous web in a paper machine, comprising the steps of:

forming the fibrous web in contact with a side of a first fabric;

carrying the fibrous web on said side of said first fabric;

contacting an other side of said first fabric with an extended nip press belt, said extended nip press belt being permeable;

contacting the fibrous web with a side of a second fabric, the fibrous web being between said first fabric and said second fabric, said first fabric being between said extended nip press belt and the fibrous web; and passing air successively through said extended nip press belt, said first fabric, the fibrous web and said second fabric.

19. The method of claim 18, wherein said first fabric is a structured fabric and said second fabric is a dewatering fabric.

20. The method of claim 19, wherein said structured fabric includes a plurality of valleys and a plurality of peaks.

21. The method of claim 19, wherein said dewatering fabric includes:

at least one batt fiber layer; and a permeable fabric, said at least one batt fiber layer and said permeable fabric being needle punched with straight through drainage channels.

22. The method of claim 21, wherein said dewatering fabric further comprises at least one anti-rewet layer attached to at least one of said permeable fabric and said at least one batt fiber.

23. The method of claim 22, wherein said anti-rewet layer is an elastomeric membrane.

24. The method of claim 23, wherein said elastomeric membrane is less than approximately 1.05 mm thick.

25. The method of claim 24, wherein said dewatering fabric further comprises an anti-rewet layer having a first side and a second side, said first side attached to said permeable fabric, said at least one batt fiber layer includes an other batt fiber layer connected to said second side.

26. The method of claim 25, wherein said anti-rewet layer includes pores therethrough.

27. The method of claim 26, wherein said pores have a mean pore diameter in the range of approximately 5 microns to approximately 75 microns.

28. The method of claim 18, wherein said passing step is accomplished by at least one of the steps of:

placing a negative air pressure on an other side of said second fabric; and placing a positive air pressure on an other side of said first fabric.

29. The method of claim 28, wherein only said placing a negative air pressure step is executed.

30. The method of claim 29, wherein said placing a negative air pressure step is applied by a vacuum roll.

31. The method of claim 30, further comprising the step of applying a vacuum of between approximately −0.2 bar to approximately −0.8 bar by way of said vacuum roll.

32. The method of claim 30, further comprising the step of applying a vacuum of at least −0.4 bar.

33. The method of claim 18, further comprising the step of conveying said first fabric with the fibrous web to at least one of a Yankee roll, a suction roll, a hot air hood, a boost dryer, a suction box, an air press, a High Pressure Through Air Dryer and a two pass High Pressure Through Air Dryer.

34. The method of claim 33, wherein said conveying step is conveying said first fabric with the fibrous web to said Yankee roll.

* * * * *